US006489547B2

(12) United States Patent
Chang

(10) Patent No.: US 6,489,547 B2
(45) Date of Patent: Dec. 3, 2002

(54) METAL DRUM FRAME WITH FIXING LUGS

(76) Inventor: Ming-Yi Chang, P.O. Box 2103, Taichung (TW)

( * ) Notice: Subject to any disclaimer, the term of this patent is extended or adjusted under 35 U.S.C. 154(b) by 220 days.

(21) Appl. No.: 09/756,176

(22) Filed: Jan. 9, 2001

(65) Prior Publication Data

US 2002/0088332 A1 Jul. 11, 2002

(51) Int. Cl.[7] ..... G10D 13/02
(52) U.S. Cl. ..... 84/411 R; 84/413; 84/411 A
(58) Field of Search ..... 84/411 R, 413, 84/411 A

(56) References Cited

U.S. PATENT DOCUMENTS 887,016 A * 5/1908 Poland ..... 84/411 R
3,105,406 A * 10/1963 Ippolito ..... 84/411 R
4,475,434 A * 10/1984 Willis ..... 84/411 R
5,844,157 A * 12/1998 Kasha ..... 84/415

* cited by examiner

*Primary Examiner*—Shih-Yung Hsieh

(57) ABSTRACT

A metal drum frame with fixing lugs. A drumhead is mounted on each end face of a drum barrel of the drum. A drum frame is mounted around each drumhead. A top and a bottom edges of the drum frame are respectively formed with hollow bulge lips. A portion of the drum frame between the lips is recessed to form a waist section. The waist section of the drum frame is formed with several outward extending lugs. The lug is formed in such a manner that the waist section is transversely cut with two parallel cut lines defining the lug. The portion of the waist section between the two cut lines protrudes outward to form a substantially hollow hoop shape. A locking member is disposed in the lug. A bolt is passed through the locking member to tension the drumhead.

4 Claims, 5 Drawing Sheets

METAL DRUM FRAME WITH FIXING LUGS

BACKGROUND OF THE INVENTION

The present invention relates to a metal drum frame with fixing lugs, and more particularly to a metal drum frame which has fixing lugs and beautiful appearance and is manufactured at lower cost.

FIG. 9 shows a conventional metal drum frame 7 of a small-size drum. The drum frame 7 is made of a metal sheet by bending. The lower edge of the drum frame 7 is formed with an outward horizontally extending flange 71 having multiple locking sections 72. Each locking section 72 has a thread hole 73. A bolt 61 is passed through the thread hole 73 and screwed into a fixing seat 62 of the drum body 6 for tensioning the drumhead 63.

Such drum frame 7 is made of one single metal sheet so that it has weaker strength. Therefore, such drum frame 7 is only suitable for small-size drum. In case such drum frame is applied to large-size drum, the drum frame is liable to deform and can hardly evenly tension the drumhead 63. As a result, the quality of the drum sound will be affected.

FIG. 10 shows a metal drum frame 9 of a conventional large-size drum. The drum frame 9 is made of a metal tube by rolling and has higher strength. However, the drum frame 9 itself lacks design for the bolt 92 to pass and lock. An additional latch member 91 is used to clamp the top edge of the drum frame 9 and the bolt 92 is passed through the bolt hole of the latch member 91 and tightened, whereby the drum frame can tension the drumhead. Such latch member 91 is made by many punching steps for achieving greater strength so that the manufacturing cost is higher and the manufacturing time is longer. This increases the manufacturing cost for the drum frame.

SUMMARY OF THE INVENTION

It is therefore a primary object of the present invention to provide a metal drum frame with fixing lugs. A top and a bottom edges of the drum frame are respectively formed with hollow bulge reinforced lips. A portion of the drum frame between the lips is recessed to form a waist section. The waist section of the drum frame is punched with several outward extending lugs which have a substantially hollow hoop shape. A locking member is disposed in the lug. A bolt is passed through the locking member to tension the drumhead. According to the above arrangement, the manufacturing cost is lowered and the appearance of the drum is enhanced as well as the strength of the drum frame is increased.

The present invention can be best understood through the following description and accompanying drawings wherein:

DETAILED DESCRIPTION OF THE PREFERRED EMBODIMENTS

Figure 1:
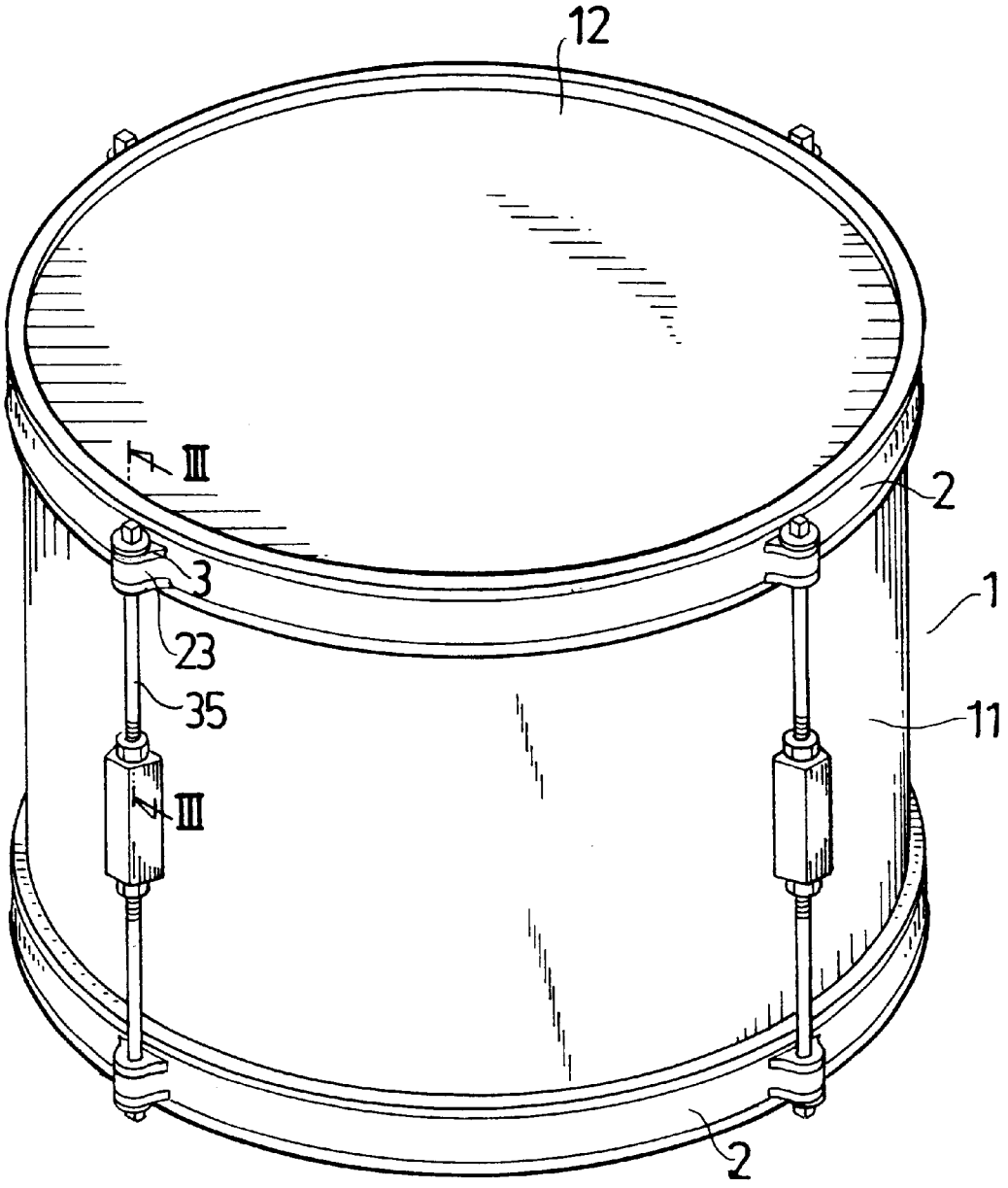
FIG. 1 is a perspective view of the metal drum frame of the present invention.
Figure 2:
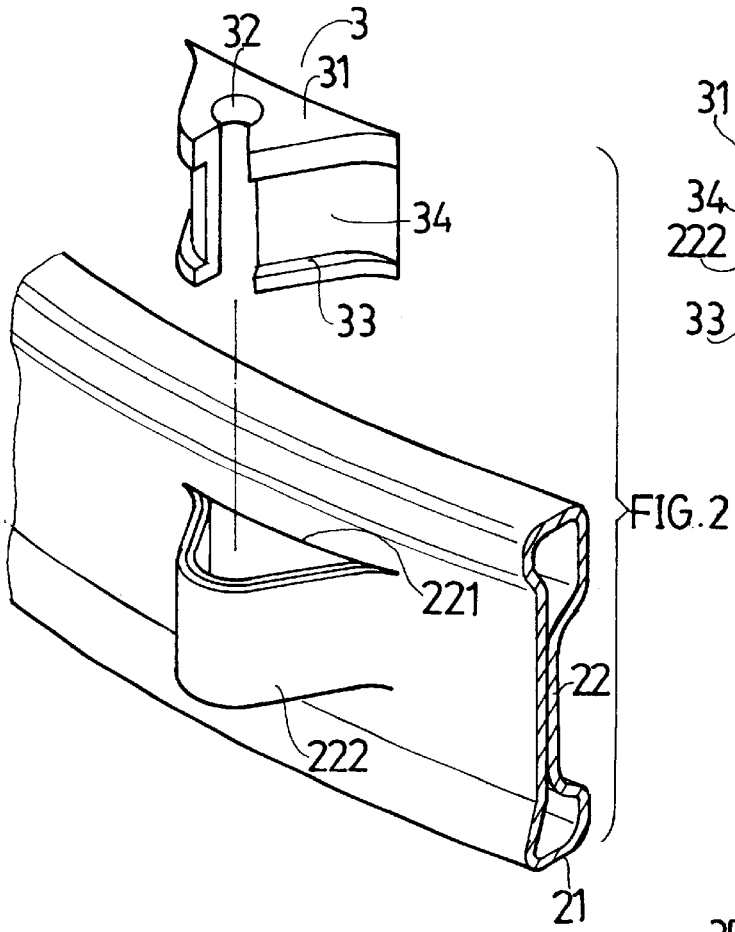
FIG. 2 is an enlarged view of a part of the metal drum frame of the present invention.
Figure 3:
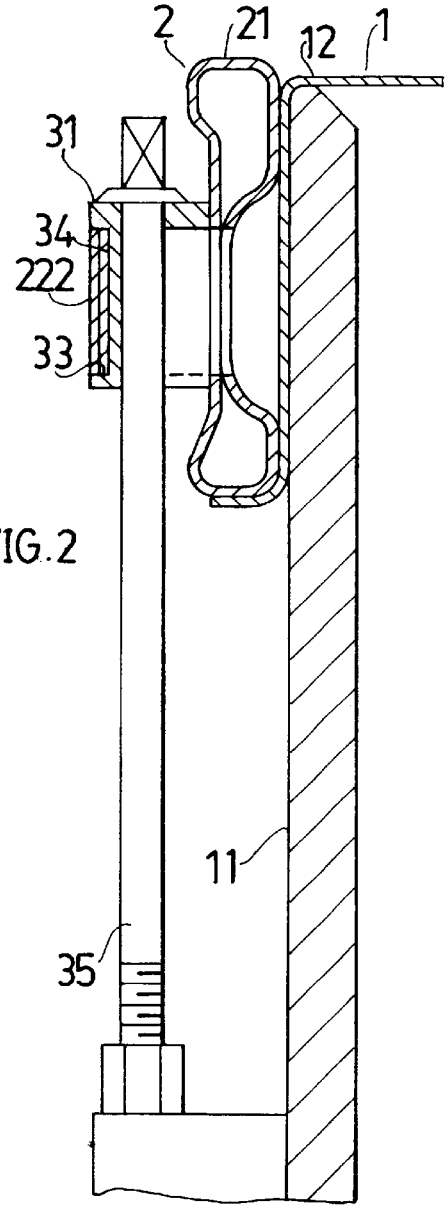
FIG. 3 is a sectional view taken along line III—III of FIG. 1.
Figure 4:
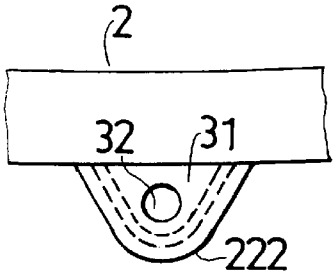
FIG. 4 is a top view of a part of the drum frame of the present invention.

Please refer to FIGS. 1 to 4. According to a preferred embodiment of the present invention, a drumhead 12 is mounted on each end face of the drum barrel 11 of the drum 1. An annular drum frame 2 is mounted around each of the top and bottom ends of the drum barrel 11. The drum frame 2 is made of a metal sheet by integral bending. The top and bottom edges of the drum frame 2 are respectively formed with hollow bulge lips 21. A portion between the lips 21 is recessed to form a waist section 22. The waist section 22 is formed with several outward extending lugs 222. The lug 222 can be formed by a punching mold. The waist section 22 is transversely cut with two parallel cut lines 221 defining the lug 222. The portion of the waist section 22 between the two cut lines 221 protrudes outward to form a substantially hollow hoop shape. A locking member 3 is disposed in the lug 222. The locking member 3 has a top face 31 covering the upper end of the lug 222. The locking member 3 has a side wall 34 downward extends from the top face 31 along the inner face of the lug 222. The upper and lower edges of the side wall 34 are respectively formed with two outward extending step sections 33. The upper and lower ends of the lug 222 are inlaid between the two step sections 33. The top face 31 of the locking member 3 is formed with a through hole 32 to a bolt 35 to pass therethrough.

According to the above first embodiment, the waist section 22 of the drum frame 2 is outward punched with a certain number of lugs 222 as necessary. Each lug 222 includes two layers of metal sheets so that it has sufficient strength. The locking member 3 is disposed in the lug 222 for a bolt 35 to pass therethrough to tension the drumhead 12 mounted on the drum barrel 11. Accordingly, the drumhead 12 is tightly tensioned on the drum barrel 11 and the quality of the drum sound can be ensured.

Figure 5:
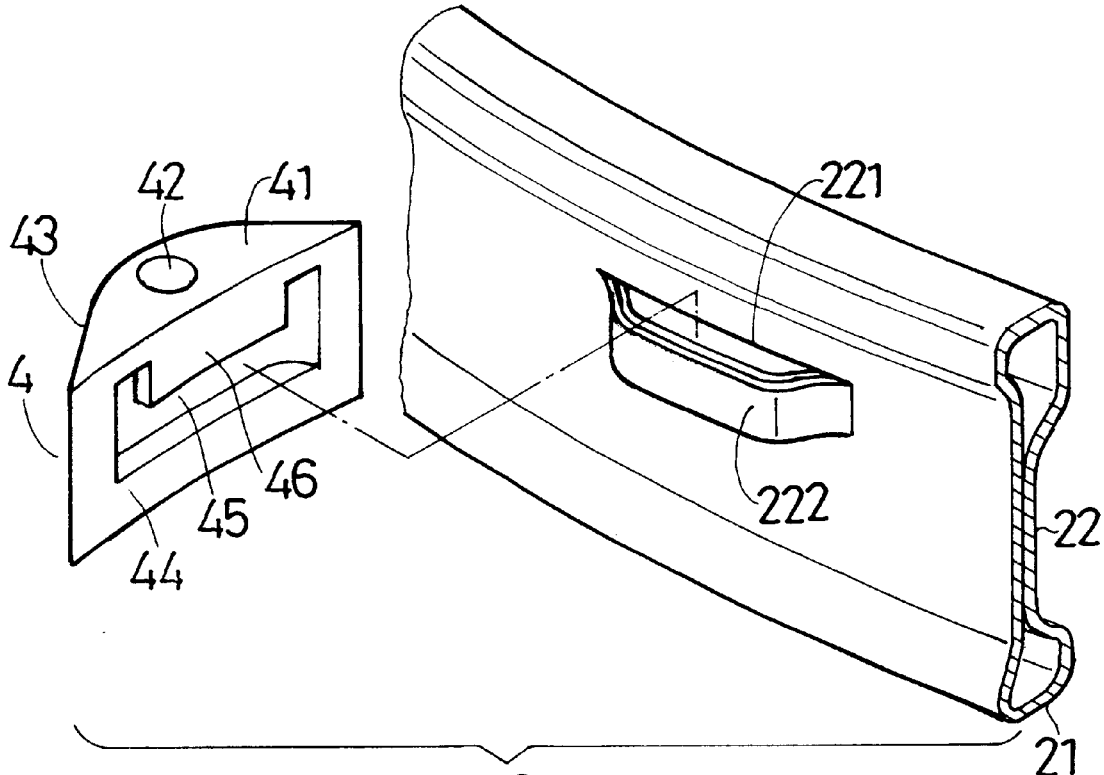
FIG. 5 is an enlarged view of a part of a second embodiment of the metal drum frame of the present invention.
Figure 6:
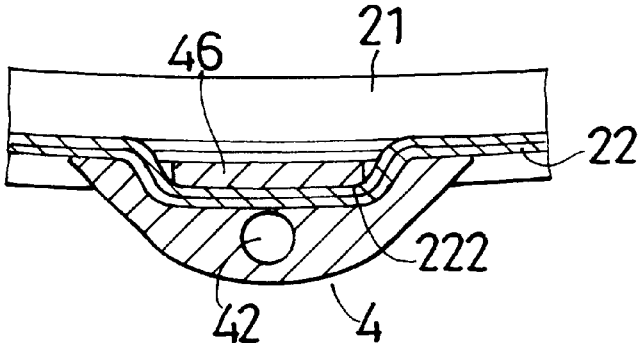
FIG. 6 is a sectional view of a part of the second embodiment of the metal drum frame of the present invention.

FIGS. 5 and 6 show a second embodiment of the present invention, in which most parts are identical to those of the first embodiment. The lug 222 slightly protrudes from outer side of the waist section 22 for a locking member 4 to hang thereon. The locking member 4 has an inner attaching face 44 for attaching to the outer face of the waist section 22. The attaching face 44 is formed with a cavity 45 for receiving the lug 222. The upper edge of the cavity 45 has a downward extending hanging hook 46 which is inserted into the interior space of the lug 222.

Figure 7:
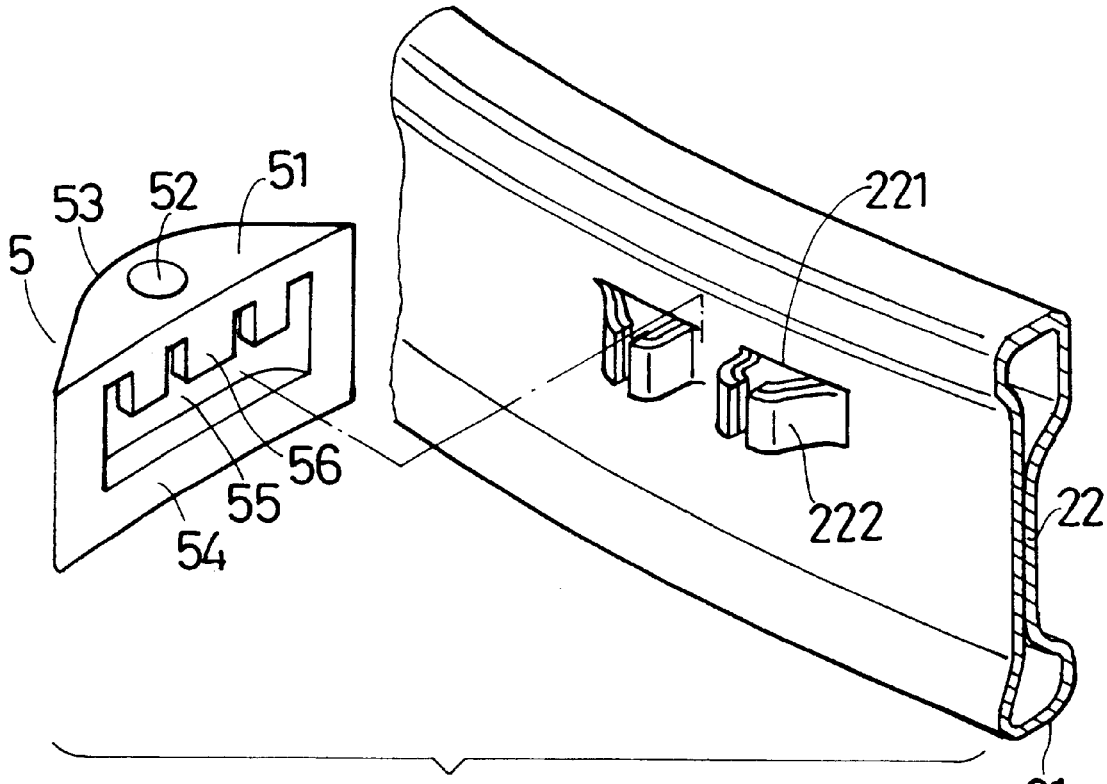
FIG. 7 is an enlarged view of a part of a third embodiment of the metal drum frame of the present invention.
Figure 8:
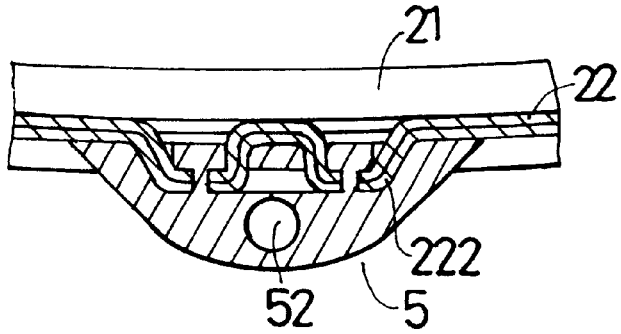
FIG. 8 is a sectional view of a part of the third embodiment of the metal drum frame of the present invention.
Figure 9:
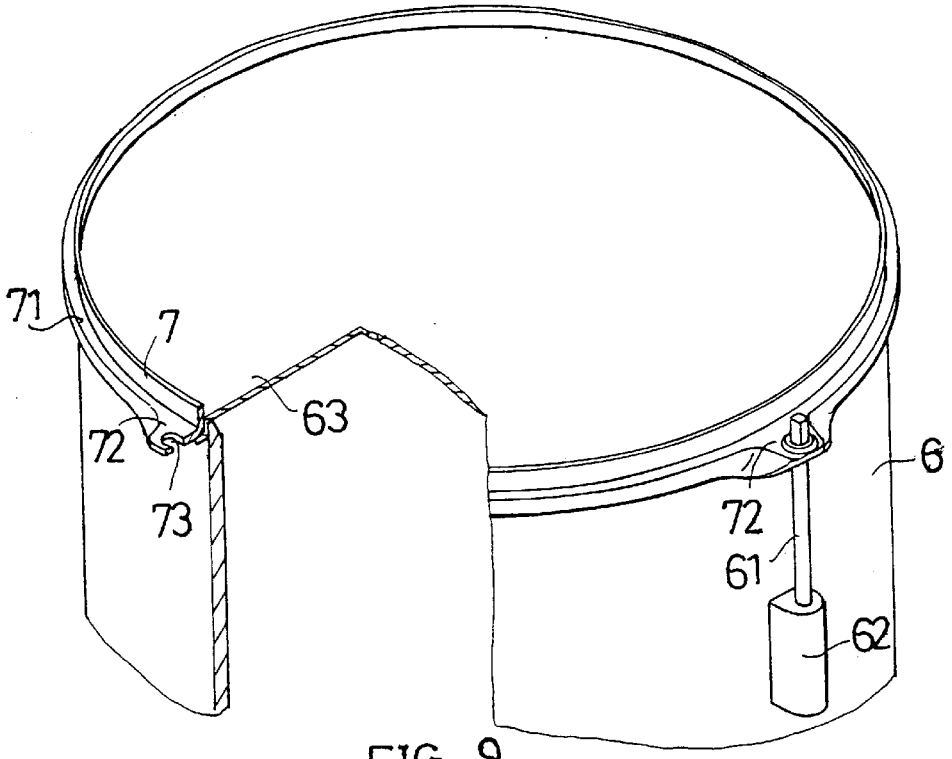
FIG. 9 PRIOR ART
FIG. 9 is a perspective partially sectional view of a conventional drum frame.
Figure 10:
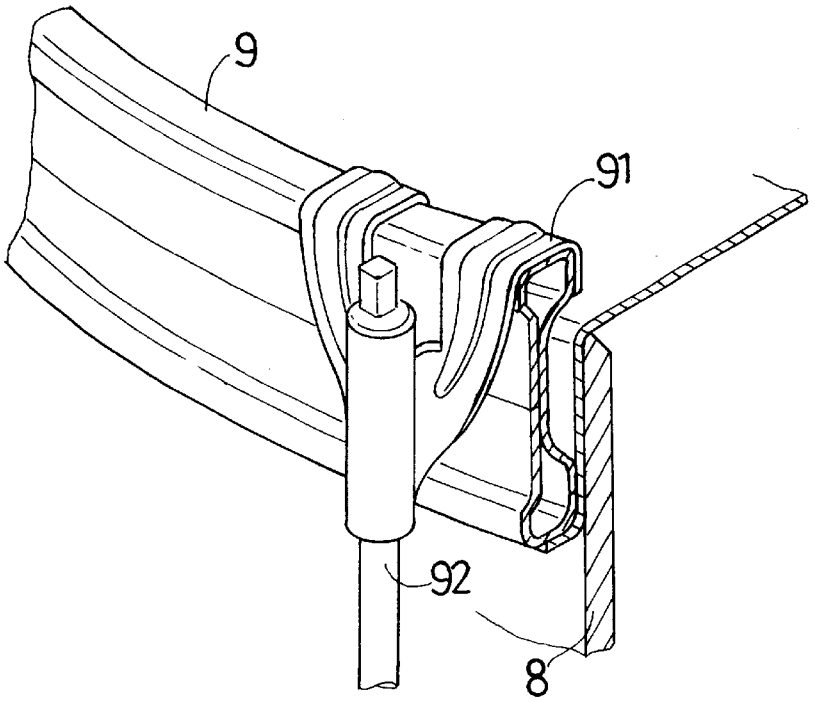
FIG. 10 PRIOR ART
FIG. 10 is a perspective partially sectional view of another conventional drum frame.

FIGS. 7 and 8 show a third embodiment of the present invention, in which the waist section 22 has two slightly outward extending lugs 222 for a locking member 5 to hang thereon. The locking member 5 has an inner attaching face 54 for attaching to the outer face of the waist section 22. The attaching face 54 is formed with a cavity 55. The upper edge of the cavity 55 has three downward extending hanging hook 56 which are respectively inserted into the interior spaces of the lug 222 and a gap between the lugs 222.

In conclusion, the waist section of the drum frame is outward punched to form the lug 222 so that the lug 222 has two layers of metal sheets and thus has sufficient strength.

The locking member can be made of plastic material so that the manufacturing time is shortened and the cost is lowered.

The above embodiments are only used to illustrate the present invention, not intended to limit the scope thereof. Many modifications of the above embodiments can be made without departing from the spirit of the present invention.

What is claimed is:

1. A metal drum frame with fixing lugs comprising, a drumhead being mounted on each end face of a drum barrel of the drum, a drum frame being mounted around each drumhead, the drum frame being made of a metal sheet by integral bending, a top and a bottom edges of the drum frame being respectively formed with hollow bulge lips, a portion of the drum frame between the lips being recessed to form a waist section, said waist section of the drum frame is formed with several outward extending lugs, each lug being formed in such a manner that the waist section is transversely cut with two parallel cut lines defining the lug, the portion of the waist section between the two cut lines protruding outward to form a substantially hollow hoop shape, a locking member being disposed in the lug, the locking member having a top face formed with a through hole.

2. A metal drum frame with fixing lugs as claimed in claim 1, wherein the top face of the locking member covers the upper end of the lug, the locking member having a side wall downward extends from the top face along inner face of the lug, an upper and a lower edges of the side wall being respectively formed with two outward extending step sections, the upper and lower ends of the lug being inlaid between the two step sections.

3. A metal drum frame with fixing lugs as claimed in claim 1, wherein the lug only slightly protrudes from outer side of the waist section for a locking member to hang thereon, the locking member having an inner attaching face for attaching to the outer face of the waist section, the attaching face being formed with a cavity for receiving the lug, an upper edge of the cavity having a downward extending hanging hook which is inserted into the interior space of the lug.

4. A metal drum frame with fixing lugs as claimed in claim 1, wherein the waist section has two slightly outward extending lugs for a locking member to hang thereon, the locking member having an inner attaching face for attaching to the outer face of the waist section, the attaching face being formed with a cavity, an upper edge of the cavity having three downward extending hanging hook which are respectively inserted into the interior spaces of the lug and a gap between the lugs.

* * * * *